US010246880B1

(12) United States Patent
Nonni

(10) Patent No.: US 10,246,880 B1
(45) Date of Patent: Apr. 2, 2019

(54) ROOF EDGE CAPPING ASSEMBLY

(71) Applicant: John Nonni, New Market (CA)

(72) Inventor: John Nonni, New Market (CA)

( * ) Notice: Subject to any disclaimer, the term of this patent is extended or adjusted under 35 U.S.C. 154(b) by 0 days.

(21) Appl. No.: 15/856,212

(22) Filed: Dec. 28, 2017

(51) Int. Cl.
*E04D 13/15* (2006.01)

(52) U.S. Cl.
CPC ..... *E04D 13/15* (2013.01)

(58) Field of Classification Search
CPC . E04D 13/15; E04D 2013/1422; E04D 3/405; E04F 19/02
USPC ..... 52/102, 262, 300, 843
See application file for complete search history.

(56) References Cited

U.S. PATENT DOCUMENTS 3,331,173 A * 7/1967 Elsner ..... B29C 70/10 156/216
3,405,485 A 10/1968 Edwards
4,483,112 A 11/1984 Rueblinger
5,605,020 A 2/1997 Chambers
5,608,993 A * 3/1997 Argiropoulos ..... E04D 3/405 52/61
D397,810 S 9/1998 Basset
6,505,455 B1 1/2003 Georgeau
6,845,590 B1 1/2005 Mills, Jr.
8,863,475 B2 10/2014 Kelly

FOREIGN PATENT DOCUMENTS

WO WO9964689 12/1999

* cited by examiner

*Primary Examiner* — Patrick J Maestri

(57) ABSTRACT

A roof edge capping assembly for directing water to a roof of a building includes a housing that defines an interior space. The housing comprises steel so that the housing is rigid. The housing has a top, a bottom, opposing ends, a first side, and a second side. The bottom is configured to couple to an upper end of a wall, such as an exterior concrete wall of a building. The first side and the second side are positioned proximate to an outer face and an inner face of the wall, respectively. The first side is dimensionally taller than the second side. The top extends downwardly from the first side to the second side. The top is configured to direct water that contacts the top to a roof of the building and to prevent the water from penetrating the upper end the wall.

8 Claims, 5 Drawing Sheets

ROOF EDGE CAPPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to capping assemblies and more particularly pertains to a new capping assembly for directing water to a roof of a building.

BRIEF SUMMARY OF THE INVENTION

An embodiment of the disclosure meets the needs presented above by generally comprising a housing that defines an interior space. The housing comprises steel so that the housing is rigid. The housing has a top, a bottom, opposing ends, a first side, and a second side. The bottom is configured to couple to an upper end of a wall, such as an exterior concrete wall of a building. The first side and the second side are positioned proximate to an outer face and an inner face of the wall, respectively. The first side is dimensionally taller than the second side. The top extends downwardly from the first side to the second side. The top is configured to direct water that contacts the top to a roof of the building and to prevent the water from penetrating the upper end the wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
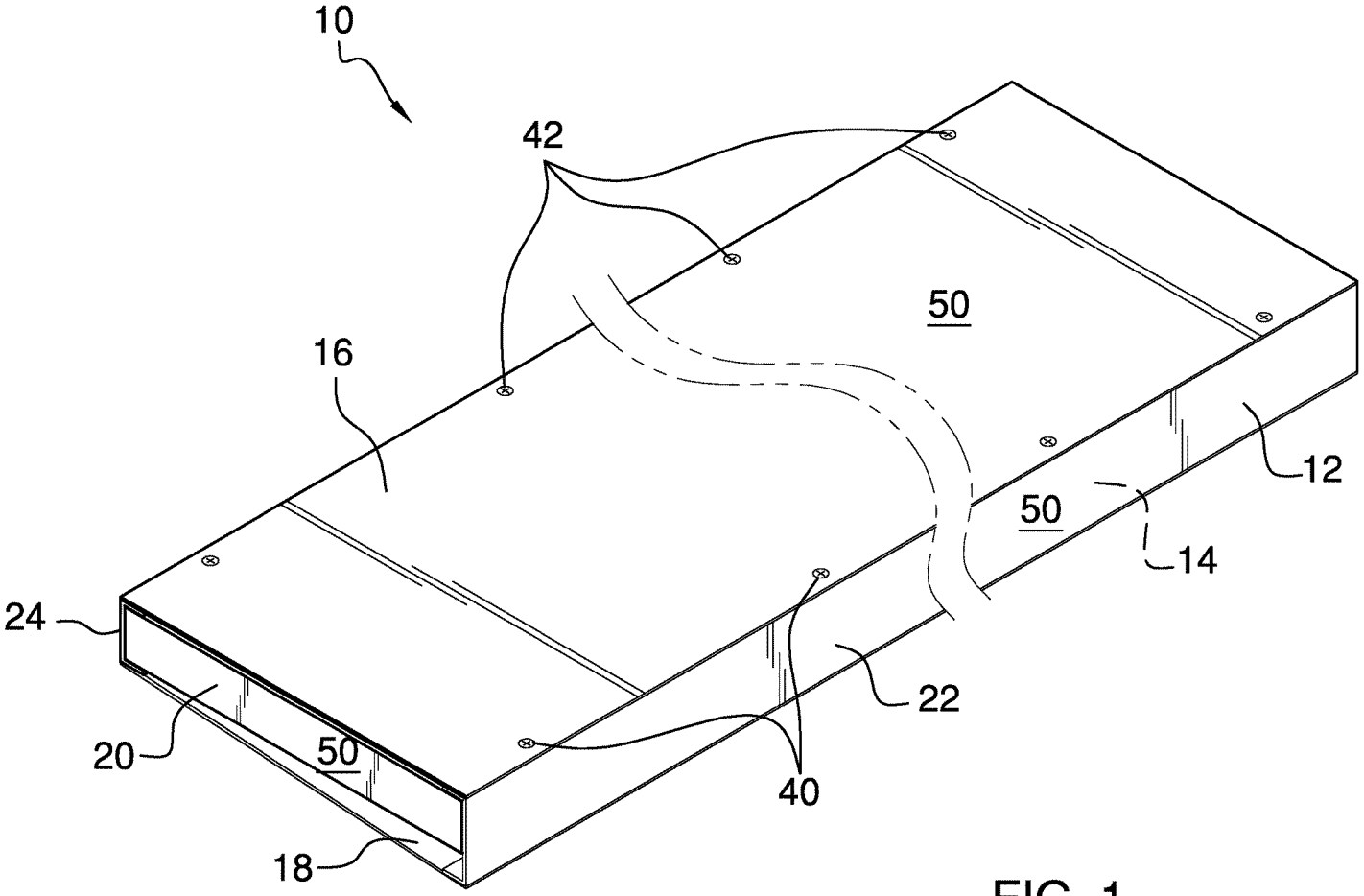
FIG. 1 is an isometric perspective view of a roof edge capping assembly according to an embodiment of the disclosure.
Figure 2:
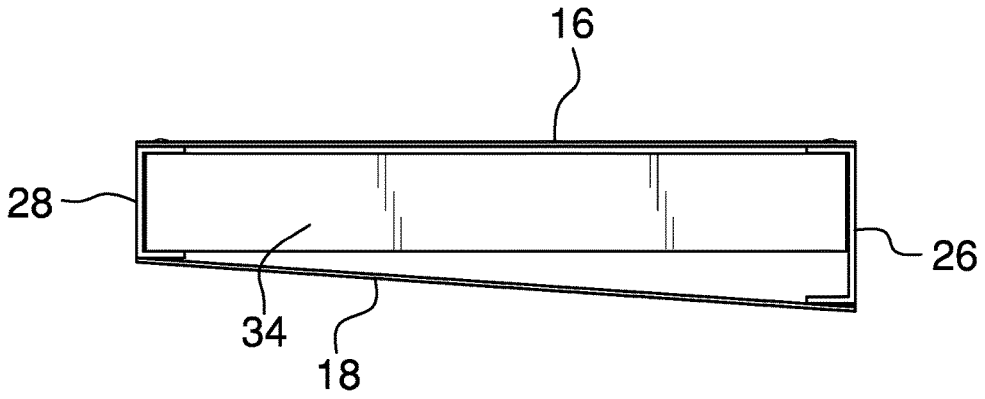
FIG. 2 is an end view of an embodiment of the disclosure.
Figure 3:
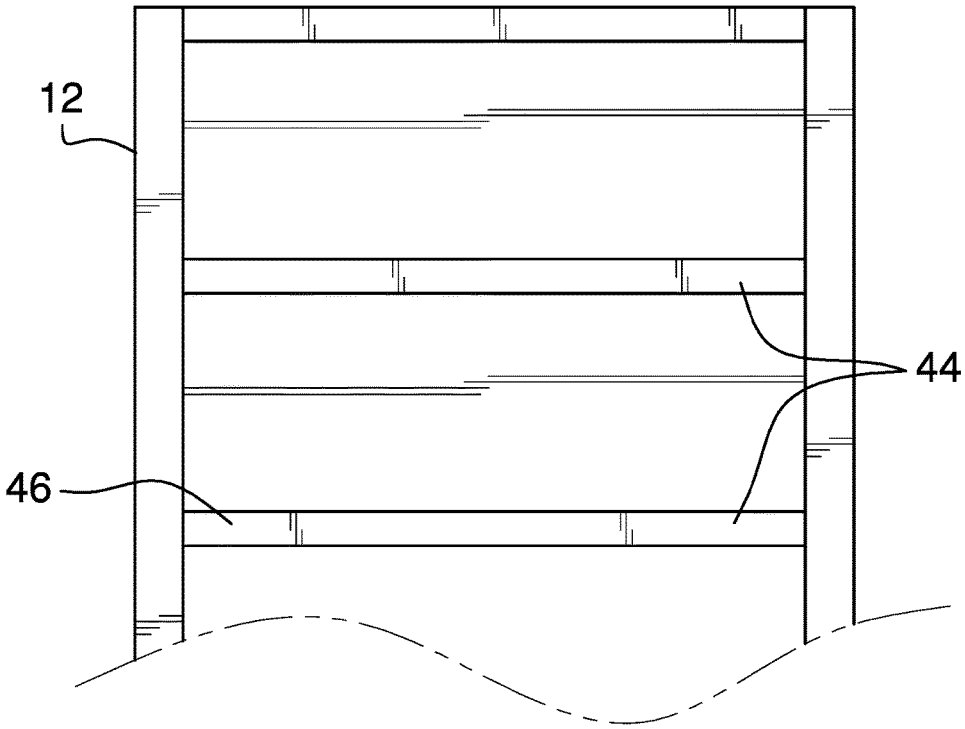
FIG. 3 is a top view of an embodiment of the disclosure.
Figure 4:
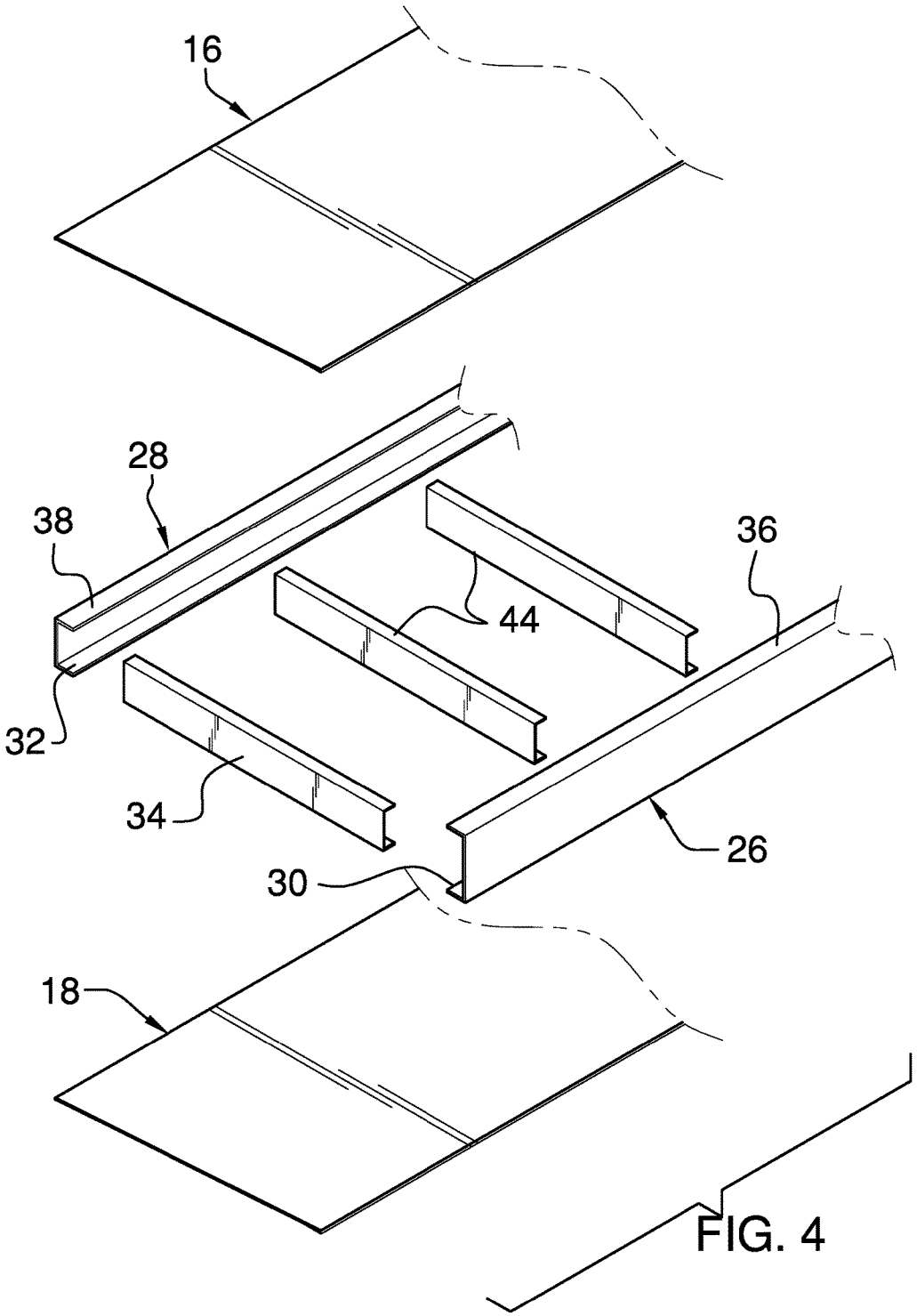
FIG. 4 is an exploded view of an embodiment of the disclosure.
Figure 5:
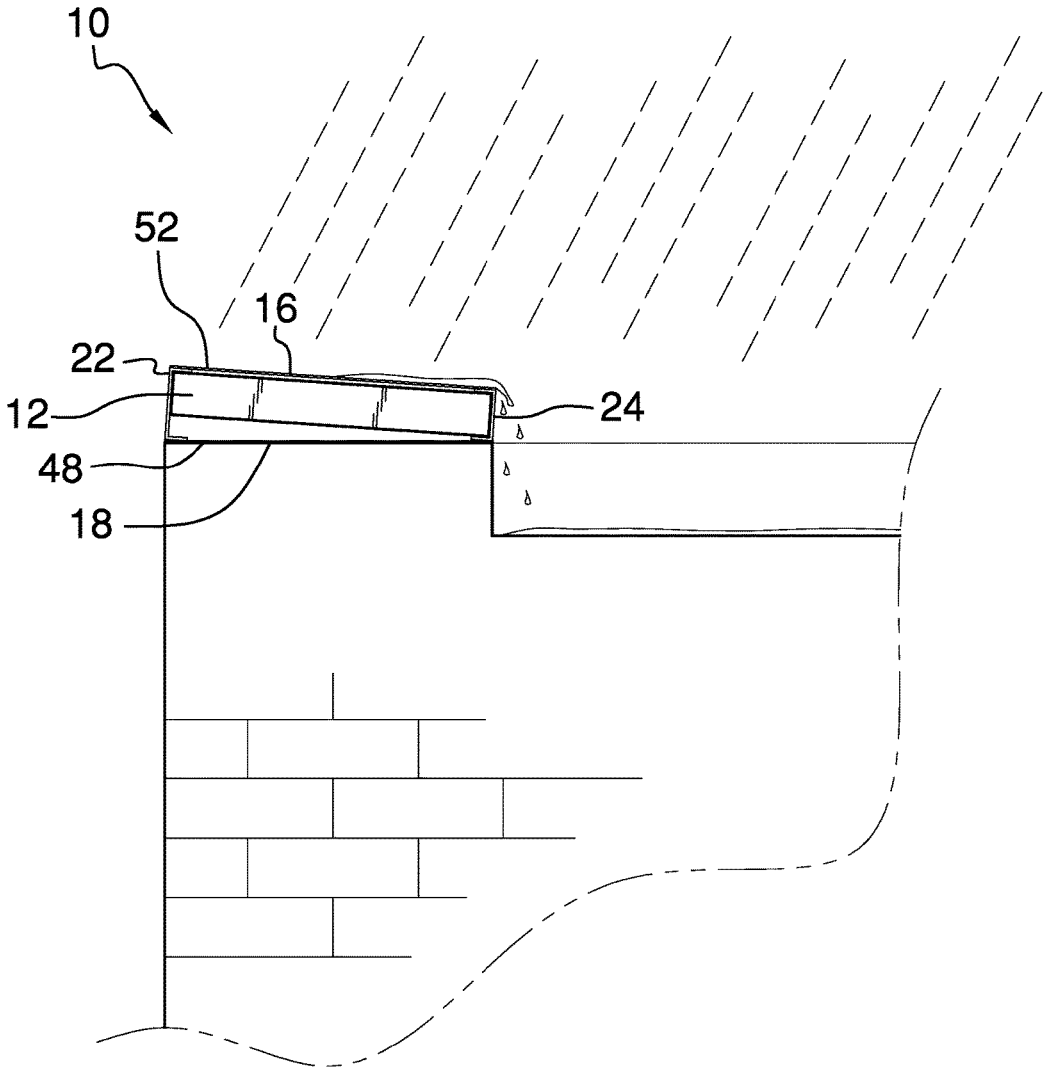
FIG. 5 is an in-use view of an embodiment of the disclosure.

With reference now to the drawings, and in particular to FIGS. 1 through 5 thereof, a new capping assembly embodying the principles and concepts of an embodiment of the disclosure and generally designated by the reference numeral 10 will be described.

As best illustrated in FIGS. 1 through 5, the roof edge capping assembly 10 generally comprises a housing 12 that defines an interior space 14. The housing 12 comprises steel so that the housing 12 is rigid. The housing 12 has a top 16, a bottom 18, opposing ends 20, a first side 22, and a second side 24. The bottom 18 is configured to couple to an upper end of a wall, such as an exterior concrete wall of a building. The first side 22 and the second side 24 are positioned proximate to an outer face and an inner face of the wall, respectively. The first side 22 is dimensionally taller than the second side 24 so that the top 16 extends downwardly from the first side 22 to the second side 24. The top 16 is configured to direct water that contacts the top 16 to a roof of the building and to prevent the water from penetrating the upper end the wall.

In one embodiment, the first side 22 comprises a first C-channel 26 and the second side 24 comprises a second C-channel 28. The first C-channel 26 and the second C-channel 28 comprise steel. The bottom 18 is coupled to and extends between a first edge 30 of the first C-channel 26 and a first rim 32 of the second C-channel 28. In another embodiment, each opposing end 20 comprises a third C-channel 34. The third C-channels 34 comprise steel.

The top 16 is selectively couplable to a second edge 36 of the first C-channel 26 and a second rim 38 of the second C-channel 28. The interior space 14 is configured to insert screws, such as concrete screws, through the bottom 18 into the upper end of the wall to couple the housing 12 to the wall. The interior space 14 also is configured to selectively insert insulating material. The top 16 is positioned to couple to the second edge 36 and the second rim 38 to close the interior space 14.

The assembly 10 comprises a plurality of first screws 40 and a plurality of second screws 42. The first screws 40 and the second screws 42 are sheet-metal type. The first screws 40 are configured to insert through the top 16 and the second edge 36 to couple the top 16 to the second edge 36. The second screws 42 are configured to insert through the top 16 and the second rim 38 to couple the top 16 to the second rim 38 to close the interior space 14.

A plurality of struts 44 is coupled to and extends between the first side 22 and the second side 24. The struts 44 are positioned to rigidify the housing 12. In one embodiment, each strut 44 comprises a fourth C-channel 46. The fourth C-channels 46 comprise steel.

A first vapor barrier 48 is coupled to an exterior 50 of the housing 12. The first vapor barrier 48 is positioned on the bottom 18, the opposing ends 20, the first side 22, and the second side 24. The first vapor barrier 48 is configured to sealably couple the opposing ends 20, the first side 22, and the second side 24 to the bottom 18. A second vapor barrier 52 selectively couplable to the top 16, the opposing ends 20, the first side 22, and the second side 24 so that moisture is prevented from entering the interior space 14.

In use, the first vapor barrier 48 is configured to sealably couple the opposing ends 20, the first side 22, and the second side 24 to the bottom 18. The struts 44 that are positioned in the interior space 14 are positioned to rigidify the housing 12. The top 16 is selectively couplable to the first side 22 and the second side 24 so that the interior space 14 is configured to insert the screws, such as the concrete screws, through the bottom 18 into the upper end of the wall to couple the housing 12 to the wall. The interior space 14 also is configured to selectively insert the insulating material.

The first screws 40 are configured to insert through the top 16 and the second edge 36 to couple the top 16 to the second edge 36. The second screws 42 are configured to insert through the top 16 and the second rim 38 to couple the top 16 to the second rim 38 so that the top 16 is positioned to close the interior space 14. The second vapor barrier 52 is configured to sealably couple the opposing ends 20, the first side 22, and the second side 24 to the top 16 so that moisture is prevented from entering the interior space 14. The top 16 is configured to direct the water that contacts the top 16 to the roof of the building and to prevent the water from penetrating the upper end the wall.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roof edge capping assembly comprising:

a housing defining an interior space, said housing comprising steel such that said housing is rigid, said housing having a top, a bottom, opposing ends, a first side, and a second side, said bottom being configured for coupling to an upper end of a wall such that said first side and said second side are positioned proximate to an outer face and an inner face of the wall, respectively, said first side being dimensionally taller than said second side such that said top extends downwardly from said first side to said second side, said first side comprising a first C-channel, said second side comprising a second C-channel, said first C-channel and said second C-channel comprising steel, said bottom being coupled to and extending between a first edge of said first C-channel and a first rim of said second C-channel; and wherein said top is positioned on said first side and said second side such that said top is configured for directing water contacting said top to a roof of the building and for preventing the water from penetrating the upper end the wall.

2. The assembly of claim 1, further including said top being selectively couplable to a second edge of said first C-channel and a second rim of said second C-channel such that said interior space is configured for permitting insertion of screws through said bottom into the upper end of the wall for coupling said housing to the wall and such that said interior space is configured for insertion of insulating material into said interior space, wherein said top is positioned for coupling to said second edge and said second rim for closing said interior space.

3. The assembly of claim 1, further including each said opposing end comprising a third C-channel, said third C-channels comprising steel.

4. The assembly of claim 2, further comprising:

a plurality of first screws, said first screws being sheet-metal type such that said first screws are configured for inserting through said top and said second edge for coupling said top to said second edge; and a plurality of second screws, said second screws being sheet-metal type such that said second screws are configured for inserting through said top and said second rim for coupling said top to said second rim for closing said interior space.

5. The assembly of claim 1, further including a plurality of struts coupled to and extending between said first side and said second side, wherein said struts are positioned in said interior space such that said struts are positioned for rigidifying said housing.

6. The assembly of claim 5, further including each said strut comprising a fourth C-channel, said fourth C-channels comprising steel.

7. The assembly of claim 2, further comprising:

a first vapor barrier coupled to an exterior of said housing, said first vapor barrier being positioned on said bottom, said opposing ends, said first side, and said second side;

a second vapor barrier selectively couplable to said top, said opposing ends, said first side, and said second side; and wherein said first vapor barrier is positioned on said housing such that said first vapor barrier is configured for sealably coupling said opposing ends, said first side, and said second side to said bottom, wherein said second vapor barrier is positioned on said housing such that said second vapor barrier is configured for sealably coupling said opposing ends, said first side, and said second side to said top such that moisture is prevented from entering said interior space.

8. A roof edge capping assembly comprising:

a housing defining an interior space, said housing comprising steel such that said housing is rigid, said housing having a top, a bottom, opposing ends, a first side, and a second side, said bottom being configured for coupling to an upper end of a wall such that said first side and said second side are positioned proximate to an outer face and an inner face of the wall, respectively, said first side being dimensionally taller than said second side such that said top extends downwardly from said first side to said second side, wherein said top is positioned on said first side and said second side such that said top is configured for directing water contacting said top to a roof of the building and for preventing the water from penetrating the upper end the wall, said first side comprising a first C-channel, said second side comprising a second C-channel, said first C-channel and said second C-channel comprising steel, said bottom being coupled to and extending between a first edge of said first C-channel and a first rim of said second C-channel, said top being selectively couplable to a second edge of said first C-channel and a second rim of said second C-channel such that said interior space is configured for inserting screws through said bottom into the upper end of the wall for coupling said housing to the wall and such that said interior space is configured for selectively inserting insulating material, wherein said top is positioned for coupling to said second side and said second rim for closing said interior space, each said opposing end comprising a third C-channel, said third C-channels comprising steel;

a plurality of first screws, said first screws being sheet-metal type such that said first screws are configured for inserting through said top and said second edge for coupling said top to said second edge;

a plurality of second screws, said second screws being sheet-metal type such that said second screws are configured for inserting through said top and said second rim for coupling said top to said second rim for closing said interior space;

a plurality of struts coupled to and extending between said first side and said second side, wherein said struts are positioned in said interior space such that said struts are positioned for rigidifying said housing, each said strut comprising a fourth C-channel, said fourth C-channels comprising steel;

a first vapor barrier coupled to an exterior of said housing, said first vapor barrier being positioned on said bottom, said opposing ends, said first side, and said second side, wherein said first vapor barrier is positioned on said housing such that said first vapor barrier is configured for sealably coupling said opposing ends, said first side, and said second side to said bottom;

a second vapor barrier selectively couplable to said top, said opposing ends, said first side, and said second side such that moisture is prevented from entering said interior space; and wherein said first vapor barrier is positioned on said housing such that said first vapor barrier is configured for sealably coupling said opposing ends, said first side, and said second side to said bottom, wherein said top is selectively couplable to said first side and said second side such that said interior space is configured for inserting the screws through said bottom into the upper end of the wall for coupling said housing to the wall and such that said interior space is configured for selectively inserting the insulating material, wherein said first screws are configured for inserting through said top and said second edge for coupling said top to said second edge, wherein said second screws are configured for inserting through said top and said second rim for coupling said top to said second rim such that said top is positioned for closing said interior space, wherein said second vapor barrier is positioned on said housing such that said second vapor barrier is configured for sealably coupling said opposing ends, said first side, and said second side to said top such that moisture is prevented from entering said interior space, wherein said top is positioned on said first side and said second side such that said top is configured for directing the water contacting said top to the roof of the building and for preventing the water from penetrating the upper end the wall.

* * * * *